US008622639B2

(12) United States Patent
Weingartner

(10) Patent No.: US 8,622,639 B2
(45) Date of Patent: Jan. 7, 2014

(54) METHOD OF PRODUCING A PRINT HEAD SUPPORT AND A PRINT HEAD SUPPORT

(75) Inventor: Peter Weingartner, Dölsach (AT)

(73) Assignee: Durst Phototechnik Digital Technology GmbH, Linz (AT)

( * ) Notice: Subject to any disclaimer, the term of this patent is extended or adjusted under 35 U.S.C. 154(b) by 668 days.

(21) Appl. No.: 12/156,555

(22) Filed: Jun. 3, 2008

(65) Prior Publication Data

US 2009/0001243 A1 Jan. 1, 2009

(30) Foreign Application Priority Data

Jun. 4, 2007 (AT) ..... A 882/2007

(51) Int. Cl.
*B41J 23/00* (2006.01)

(52) U.S. Cl.
CPC ..... *B41J 23/00* (2013.01)
USPC ..... 400/354; 52/843

(58) Field of Classification Search
USPC ..... 52/207, 223.8, 223.9, 223.12, 839, 52/842–847; 212/253, 347; 29/521, 524, 29/56.5, 564.1; 400/352, 354, 691, 693
See application file for complete search history.

(56) References Cited

U.S. PATENT DOCUMENTS 4,248,025 A * 2/1981 Kleine et al. ..... 52/845
4,494,910 A * 1/1985 Hahn et al. ..... 416/226
4,905,359 A * 3/1990 Maier et al. ..... 29/33.52
6,332,301 B1 * 12/2001 Goldzak ..... 52/223.12
6,379,064 B1 4/2002 Giles et al.
6,427,310 B1 8/2002 Kerr
6,918,651 B2 * 7/2005 Menendez et al. ..... 347/37
7,739,854 B2 * 6/2010 Yamazaki et al. ..... 52/844
2007/0000886 A1 1/2007 Yamazaki et al.

FOREIGN PATENT DOCUMENTS

| | | |
|---|---|---|
| DE | 199 42 057 | 3/2001 |
| DE | 101 05 001 | 8/2001 |
| DE | 100 09 713 | 9/2001 |
| DE | 699 26 723 | 8/2006 |
| EP | 1 029 697 | 8/2000 |
| EP | 1 854 577 | 11/2007 |
| GB | 2 387 816 | 10/2003 |
| JP | 2000-263356 A | 9/2000 |
| JP | 2003-340661 A | 12/2003 |

* cited by examiner

*Primary Examiner* — Joshua J Michener
*Assistant Examiner* — Matthew J Smith
(74) *Attorney, Agent, or Firm* — Collard & Roe, P.C.

(57) ABSTRACT

The invention relates to a method of producing a support (1) in the form of a prismatic hollow body and a support. The walls of the support (1) are formed by assembling top belt modules (2), bottom belt modules (3), front wall modules (4) and rear wall modules (5) respectively one after the other in the longitudinal direction of the support. Disposed in the interior of the support (1) at distances apart are transverse webs (6) and at least one guide track (7, 9) is provided on the support (1) extending in its longitudinal direction for a unit mounted so that it can move along the guide track. In order to obtain a high precision of the guide tracks (6, 7), the latter are formed by machining regions of the modules (2, 3, 4, 5) to remove material after the modules und transverse webs have been assembled.

8 Claims, 4 Drawing Sheets

METHOD OF PRODUCING A PRINT HEAD SUPPORT AND A PRINT HEAD SUPPORT

CROSS REFERENCE TO RELATED APPLICATIONS

Applicant claims priority under 35 U.S.C. §119 of AUSTRIAN Patent Application No. A 882/2007 filed on Jun. 4, 2007.

BACKGROUND OF THE INVENTION

1. Field of the Invention

The invention relates to a method of producing a support in the form of a prismatic hollow body, the walls of which are formed by assembling top belt modules, bottom belt modules, front wall modules and rear wall modules respectively one after the other in the longitudinal direction of the support, and transverse webs are disposed at distances apart in the interior of the support, and at least one guide track is provided on the support extending in its longitudinal direction for a unit mounted so that it can move along the guide track.

2. Prior Art

Patent application US 2007/0000886 A1 discloses a method of producing a support and a machine bed of a machine tool. The machine tool has a carriage which can be displaced on guide tracks of a support, which bears a processing head. The support can in turn be displaced on guide tracks of the machine bed. The document describes a technique which makes production of the support and machine bed easy by assembling sheet metal parts which are cut by means of laser beams.

The technique of moving a processing head which is displaceably mounted on a support and where the support itself can also be moved in a direction extending transversely to its longitudinal axis if necessary is not only used for machine tools but also for plotters and printers for example, and the processing head in these instances is a print head. In all cases, it is necessary to make the support as precisely and resistant to bending as possible whilst being of the lowest possible weight.

SUMMARY OF THE INVENTION

The objective of this invention is to propose a method of producing a support of the generic type, the at least one guide track of which is made to a higher degree of precision than the guide tracks of known supports. It should be possible to implement the manufacturing method with less complexity than the technique known from the prior art in terms of the actual manufacture and machinery involved.

This objective is achieved by the invention due to the fact that the at least one guide track is formed by machining regions of the modules to remove material after the modules and transverse webs have been assembled.

The advantage gained as a result of this method resides in the fact that the guide track can be made to a higher degree of precision than is the case with known manufacturing methods.

The invention further relates to a support manufactured by the method proposed by the invention.

The invention further relates to a support of the type outlined above constituting a prismatic hollow body.

In the case of this support, the objective of providing a support with at least one guide track made to a high degree of precision is achieved due to the fact that the at least one guide track is formed by a section extending across the length of several modules.

The advantage gained as a result of these features resides in the fact that the guide tracks are made to a higher degree of precision than the guide tracks of the known assembled support.

In one embodiment, the modules are offset from one another in the longitudinal direction so that points at which two modules disposed one after the other in the longitudinal direction abut with one another do not sit in alignment with points at which two modules of the adjacent wall of the support disposed one after the other in the longitudinal direction of the support abut with one another. In particular, this ensures that there are no fluctuations in bending resistance across the length of the support.

Also of advantage is another embodiment in which the modules themselves and/or the modules and the transverse webs are made from different materials from one another. Consequently, the support can be further improved to suit respective requirements in terms of its bending behaviour and its behaviour when subjected to changes in temperature.

In another embodiment, the modules themselves and/or the modules and the transverse webs are joined to one another by bonding. This makes it particularly simple and inexpensive to assemble the support. If, as is the case in another embodiment, carbon fibres are incorporated in the bonded seams, the stiffness of the support can be further increased.

Also of advantage are embodiments of the type where the modules themselves and/or the modules and transverse webs are joined to one another by means of pins and/or screws.

In another embodiment, finally, pre-tensioned tensioning means are provided in the interior of the supports extending in the longitudinal direction. The pre-tensioning influences the bending behaviour of the support under load and when subjected to changes in temperature.

BRIEF DESCRIPTION OF THE DRAWINGS

The invention will be explained in more detail below with reference to examples of embodiments illustrated in the appended drawings. Of these.

DETAILED DESCRIPTION OF PREFERRED EMBODIMENTS

Figure 1:
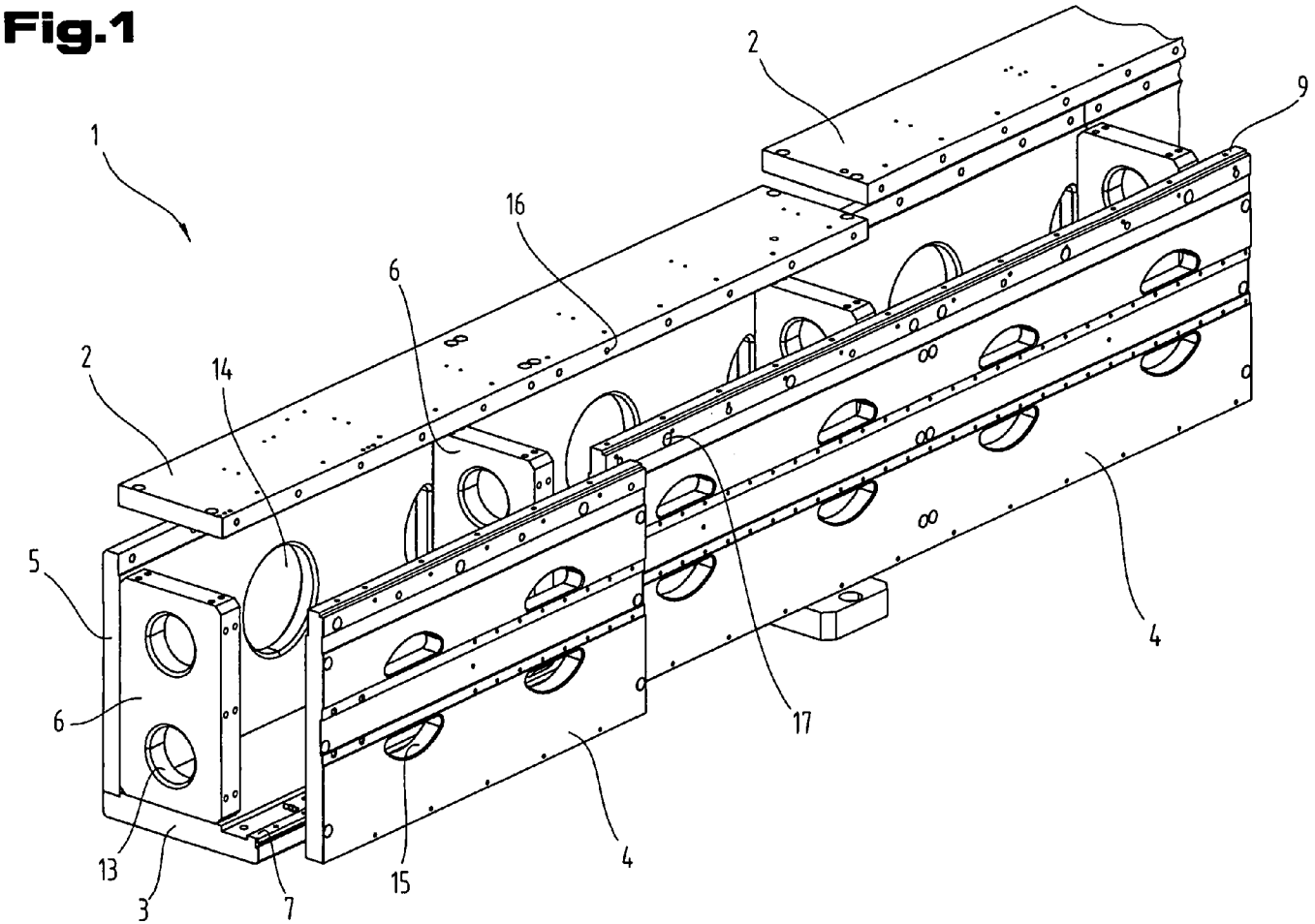
FIG. 1 is a perspective exploded diagram illustrating a portion of a support.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

The support 1, a detail of which is illustrated in FIG. 1, comprises a top belt made up of top belt modules 2 disposed one after the other in the longitudinal direction of the support 1, a bottom belt made up of bottom belt modules 3 disposed one after the other in the longitudinal direction of the support 1, a front wall made up of front wall modules 4 disposed one after the other in the longitudinal direction of the support 1 and a rear wall made up of rear wall modules 5 disposed one after the other in the longitudinal direction of the support 1. Disposed at distances apart from one another in the interior of the support 1 are transverse webs 6, which are disposed at a right angle with respect to said modules and are joined to them.

Figure 4:
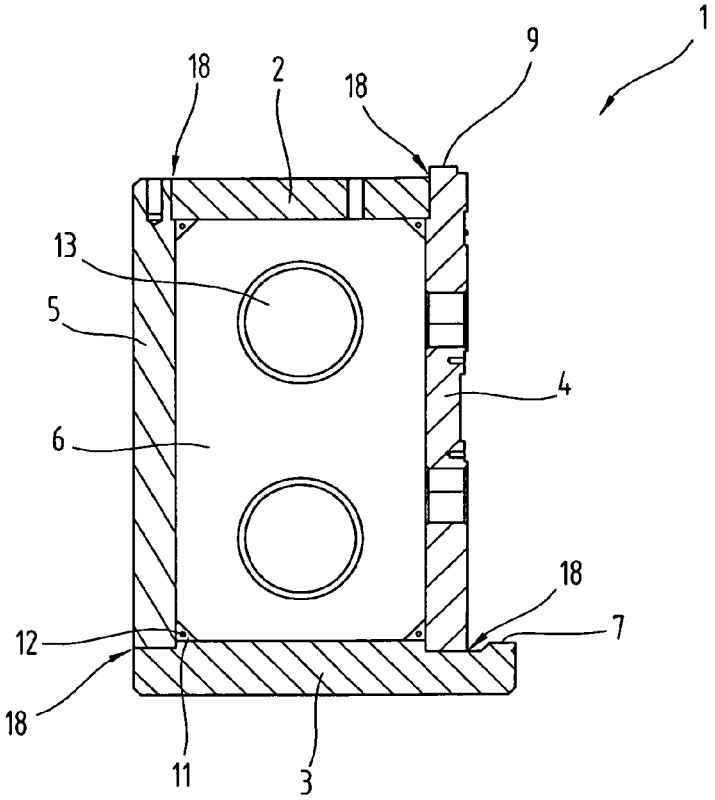
FIG. 4 illustrates the embodiment shown in FIG. 2 with the carbon fibers incorporated in the bonded seams.
Figure 5:
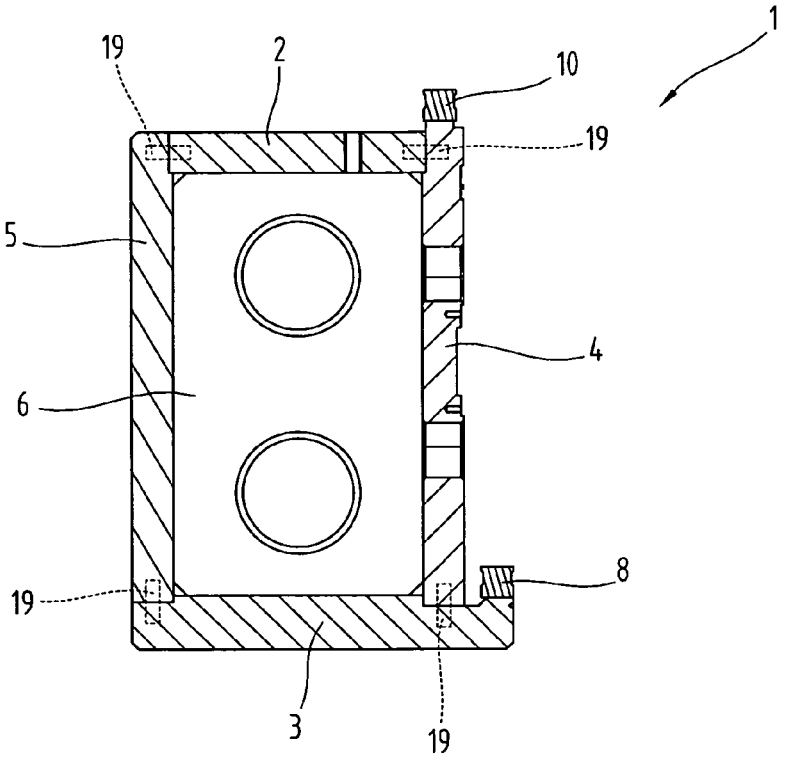
FIG. 5 illustrates a cross-section through another embodiment of the support with pins joining the modules to one another.
Figure 6:
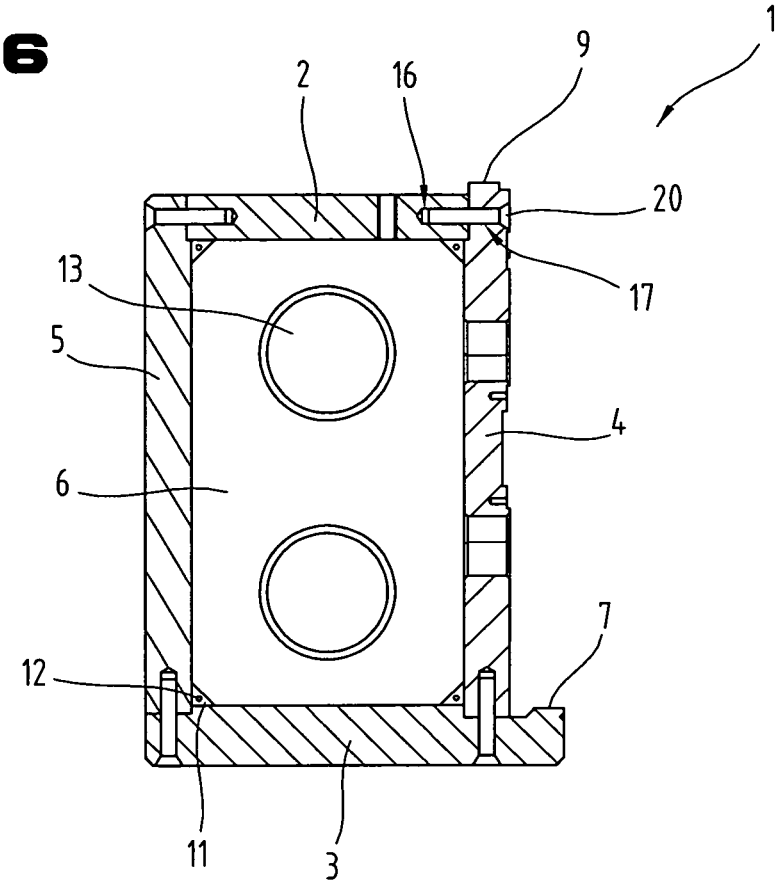
FIG. 6 illustrates a cross-section through another embodiment of the support with screws joining the modules to one another.

As may clearly be seen from FIG. 1, the various modules 2, 3, 4, 5 are offset from one another in the longitudinal direction of the support 1 so that, for example, the point at which two top belt modules 2 disposed one after the other abut with one another does not lie in the same cross-sectional plane of the support as the point at which two front wall modules 4 disposed one after the other abut with one another. This ensures that the bending strength of the support 1 is kept constant across its length. As may be seen from FIG. 1, the fact that the modules are offset means that in the end region of the support, the front wall module 4 (on the left in FIG. 1) is shorter than the front wall module adjacent to it, for example. The modules 2, 3, 4, 5 are joined to one another, in particular by bonding. By preference, the modules are additionally joined to one another by pins 19 or screws 20. See FIGS. 5 and 6. Connecting the modules by means of pins specifically improves the accuracy of the positioning of the modules with respect to one another. In order to illustrate the additional connection with pins 19 or screws 20 in FIG. 1, fixing bores 16 are shown in the top belt modules 2 and fixing bores 17 in the front wall modules 4. Fixing and positioning bores may also be provided in the transverse webs 6. Instead of bonded joints, it would also be possible to provide welded or soldered joints between the modules 2, 3, 4, 5. However, this does not offer any particular advantage due to the associated heating of the parts when it comes to obtaining the desired high precisions of the guide tracks. Depending on the demands placed on the support 1, different materials may be used for the different modules 2, 3, 4, 5. In order to increase the stiffness of the support 1, carbon fibers may be incorporated at the points or bonded seams 18 as shown in FIG. 4 where bonding is provided between the modules.

As may also be seen from FIG. 1, orifices may be provided in the modules 2, 3, 4, 5, for example orifices 13 in the transverse web 6, orifices 14 in the rear wall modules 5 and orifices 15 in the front wall modules 4. These orifices primarily serve as a means of reducing the weight of the support 1 without impairing its stiffness.

Finally, FIG. 1 also illustrates a first guide track 7 which extends across the top faces of the bottom belt modules 3 in the longitudinal direction of the support 1. A second guide track 9 extends across the top longitudinal edges of the front wall modules 4. The purpose of the guide tracks 7, 9 is to serve as a track for a unit which moves along the support 1, such as a print head for example. In view of the fact that particularly high demands are made of these guide tracks in terms of their precision, particularly in the case of large-format printers, machining involving the removal of material, for example milling, polishing, lapping or shaving, does not take place until after the support 1 has been assembled across the entire length of the support. Naturally, it would also be possible to provide guide tracks in the top belt modules 2 and/or the rear wall modules 5.

Figure 2:
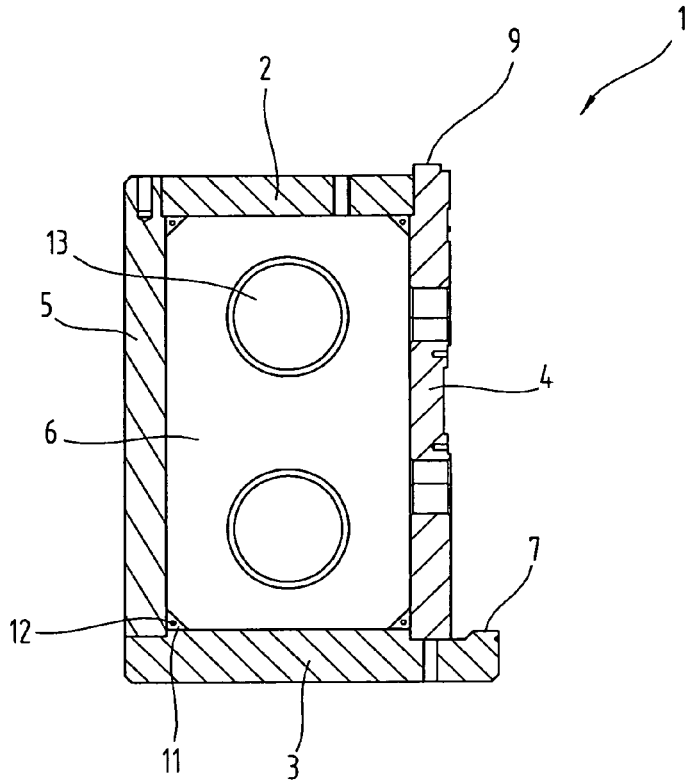
FIG. 2 illustrates a cross-section through the support illustrated in FIG. 1.

The diagram illustrating a cross-section in FIG. 2 clearly illustrates the first guide track 7 disposed in the top face of the bottom belt modules 3, which extends out to the side beyond the front wall modules 4. The second guide track 9 may also be seen, extending out from the top edge of the front wall modules 4, which top edge extends vertically out from the top belt modules 2. As a result of this design, the guide surfaces are exposed and can be subjected to a precision machining operation to remove material without any difficulty.

FIG. 2 also illustrates the fact that the corners of the transverse webs 6 are cut, thereby resulting in corner gaps extending across the entire length of the support 1. Tensioning means 12 are disposed in these corner gaps, for example steel cables or carbon fibre bundles. These tensioning means are anchored in the terminal ends of the support 1 and pre-tensioned, thereby further increasing the stiffness of the support 1 and enabling the bending behaviour of the support to be positively influenced under load.

Figure 3:
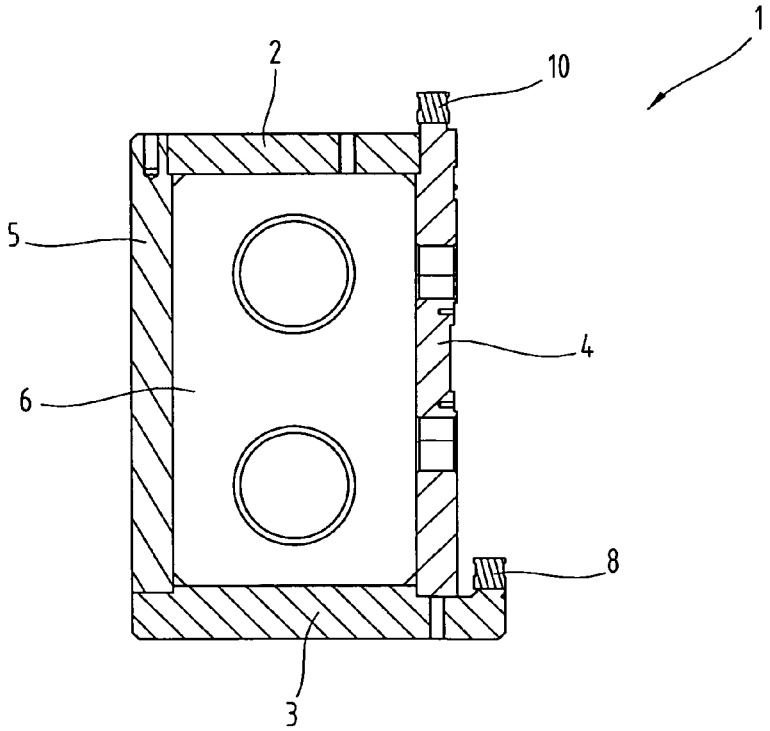
FIG. 3 illustrates a cross-section through a different embodiment of the support.

FIG. 3 illustrates another possible way of obtaining the requisite high precision of the guide tracks, whereby the latter are provided in the form of precision sections joined to the support 1. A first section 8 is disposed so that it stands out from regions of the bottom belt modules 3 projecting across the front wall and a second section 10 is positioned on the top longitudinal edges of the front wall modules 4. The sections 8, 10 may also be joined to the co-operating modules of the support 1 by bonding and additionally positioned and secured by pins and/or screws, and extend across the length of several modules, preferably across the entire length of the support.

The dimensions of a support proposed by the invention for use with a large-format printer may be as follows: length 6,000 mm, height 400 mm and width 300 mm.

The embodiments illustrated as examples represent possible design variants of the support, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the support, it and its constituent parts are illustrated to a certain extent out of scale and/or on an enlarged scale and/or on a reduced scale.

LIST OF REFERENCE NUMBERS

1 Support
2 Top belt module
3 Bottom belt module
4 Front wall module
5 Rear wall module
6 Transverse web
7 First guide track
8 First section
9 Second guide track
10 Second section

11 Corner gap
12 Tensioning means
13 Orifice in the transverse web
14 Orifice in the rear wall module
15 Orifice in the front wall module
16 Fixing orifice in the top belt module
17 Fixing orifice in the front wall module
18 bonded seam
19 pin
20 screw

What is claimed is:

1. Method of producing a print head support in the form of a prismatic hollow body, the walls of which are formed by assembling top belt modules, bottom belt modules, front wall modules and rear wall modules respectively one after the other in the longitudinal direction of the print head support, and transverse webs are provided in the interior of the print head support spaced at distances apart from one another, and at least one guide track is provided on the print head support extending in its longitudinal direction for a print head mounted so that it can move along the guide track, wherein the modules constituting the individual walls are disposed respectively one after the other in the longitudinal direction of the print head support, and the abutment points formed as a result are offset with points at which an abutment point of adjacent modules is disposed in the longitudinal direction, and the at least one guide track is formed by machining regions of the modules to remove material after the modules and transverse webs have been assembled, the machining occurring across at least several of the modules connected in the longitudinal direction.

2. Print head support in the form of a prismatic hollow body sized for a printer comprising walls formed by top belt modules, bottom belt modules, front wall modules and rear wall modules respectively one after the other in the longitudinal direction of the print head support, and transverse webs are provided in the interior of the print head support spaced at distances apart from one another, and at least one guide track is provided on the print head support extending in its longitudinal direction for a print head mounted so that it can move along the guide track, wherein the at least one guide track is formed by at least one section extending across the length of several modules, and wherein the modules are offset from one another in the longitudinal direction of the print head support so that each point at which two modules disposed one after the other in the longitudinal direction of the print head support abut with one another is offset from each point at which two modules of the adjacent wall of the print head support disposed one after the other in the longitudinal direction of the print head support abut with one another.

3. Print head support as claimed in claim 2, wherein the modules themselves and/or the modules and the transverse webs may be made from different materials from one another.

4. Print head support as claimed in claim 2, wherein the modules themselves and/or the modules and the transverse webs may be joined to one another by bonding.

5. Print head support as claimed in claim 4, wherein carbon fibers are incorporated in the bonded seams.

6. Print head support as claimed in claim 2, wherein the modules themselves and/or the modules and the transverse webs may be joined to one another by pins.

7. Print head support as claimed in claim 2, wherein the modules themselves and/or the modules and the transverse webs may be joined to one another by screws.

8. Print head support as claimed in claim 2, wherein pretensioned tensioning means are disposed in the interior of the print head support, extending in the longitudinal direction.

* * * * *